United States Patent [19]

Bedell

[11] 4,190,095

[45] Feb. 26, 1980

[54] CHILL ROLL CASTING OF CONTINUOUS FILAMENT

[75] Inventor: John R. Bedell, Sparta, N.J.

[73] Assignee: Allied Chemical Corporation, Morristown, N.J.

[21] Appl. No.: 736,690

[22] Filed: Oct. 28, 1976

[51] Int. Cl.[2] ..... B22D 11/06

[52] U.S. Cl. ..... 164/87; 164/423; 164/441

[58] Field of Search ..... 164/87, 122, 133, 276, 164/282, 423, 427, 429, 441, 442; 302/25; 226/97

[56] References Cited

U.S. PATENT DOCUMENTS

| | | | |
|---|---|---|---|
| 3,036,357 | 5/1962 | Cook et al. | 302/25 |
| 3,812,901 | 5/1974 | Stewart et al. | 164/87 |
| 3,858,642 | 1/1975 | Battiston et al. | 164/276 |
| 3,862,658 | 1/1975 | Bedell | 164/87 |
| 3,938,583 | 2/1976 | Kavesh | 164/423 |
| 3,996,993 | 12/1976 | Bonnamour | 164/87 |

*Primary Examiner*—Othell M. Simpson
*Assistant Examiner*—Gus T. Hampilos
*Attorney, Agent, or Firm*—Gerhard H. Fuchs; David W. Collins

[57] ABSTRACT

Improvement in the method for making metal filament by depositing molten metal onto the peripheral surface of a rotating annular chill roll and separating the solid filament from the chill roll, which involves applying tension to the filament, after it has been separated from the chill roll, along the direction of a tangent to the chill roll past the point at which the filament separates from the chill roll by centrifugal action, to thereby prolong its contact with the chill roll. Apparatus is provided for practice of the method.

4 Claims, 5 Drawing Figures

CHILL ROLL CASTING OF CONTINUOUS FILAMENT

BACKGROUND OF THE INVENTION

This invention relates to an improvement in the method and apparatus for making continuous metal filaments, particularly filaments of metal alloys having amorphous molecular structure, by depositing molten metal onto the peripheral surface of a rotating annular chill roll to form a solid filament thereon. The improvement effects prolonged contact between the chill roll and the solidified filament past the point where it would separate from the chill roll by action of centrifugal force.

For purposes of the present invention, a filament is a slender body whose transverse dimensions are much less than its length. In that context, filaments may be bodies such as ribbons, strips, sheets or wires, of regular or irregular cross section. As used herein, an "amorphous filament" is a filament of a metal alloy having amorphous molecular structure.

It is known to make metal filaments by directing a jet of molten metal against a rotating quench surface, or by otherwise depositing molten metal on such quench surface, whereon it is solidified in the form of a ribbon and is flung away by action of centrifugal force, as for example described by Strange and Pim in U.S. Pat. No. 905,758. In the procedure described by Strange and Pim the quench surface is furnished by a rotating chill roll. That procedure is suitable to form filaments of many of the polycrystalline metals which possess sharp melting points, that is to say, which have solid-liquid transition range of less than about 4° C. However, glassy metals having amorphous molecular structure often have a transition range in the order of about 400° C. or more through which the viscosity of the metal gradually increases until the critical glass transition temperature is reached, and it is necessary for the filament to be quenched below its glass transition temperature before departure from the quench surface. This is difficult to achieve by the procedure of Strange and Pim because centrifugal action tends prematurely to fling the filament away from the chill roll. Also, in that procedure the point of release of the filament from the surface of the chill roll varies, so that it is difficult to collect the filament and to guide it to a suitable winder.

Shortcomings concerning insufficiency of retention time of filament on the surface of the chill roll, and difficulties in collecting the filament from a variable point of release, are overcome by the procedures described by Kavesh in U.S. Pat. No. 3,856,074 and Bedell in U.S. Pat. No. 3,862,658. The Kavesh procedure involves detection of filaments formed on the exterior surface of a rotating chill roll by use of nipping means; the Bedell procedure involves prolonging the period of contact between the filament and the chill roll by exerting a force against the surface of the chill roll in the direction towards the axis of rotation of the chill roll by devices such as gas jets, moving belts and rotating wheels. While highly effective, the procedures of Kavesh and Bedell inherently involve danger of damaging the highly sensitive surface of the chill roll, as by marring it because of solid-to-solid contact between the surface of the chill roll and the nipping means, moving belts or rotating wheels, or because of accidental impingement of debris on the surface of the chill roll by the gas jets. The slightest imperfection in the surface of the chill roll will be noticeable on the surface of the filament formed, resulting in a product of inferior appearance.

A further problem inherent in chill roll casting of filament is that the point at which the filament is released and flung away from the surface of the rotating chill roll by action of centrifugal force is unstable, due to variations in adhesion between the filament and the chill roll surface. Stewart et al. in U.S. Pat. No. 3,812,901 disclose a procedure to stabilize the point of release involving supporting the filament formed on a rotating chill roll on a support member below the free flight trajectory of the filament, and applying a tension force to the filament such that it leaves the rotating chill roll without the aid of the applied tension. The magnitude of the applied tension is less than other forces causing release of the filament from the rotating chill roll, and is sufficient only to overcome variations in adhesion of the filament to the rotating chill roll, with the filament spontaneously releasing from the chill roll, with or without the application of the tension force. Stewart et al.'s method thus has the effect only of stabilizing the point of departure, but it does not prolong contact between a chill roll and the filament.

It is an object of the present invention to provide a method for obtaining controlled retention of metal filament formed on the peripheral surface of a rotating chill roll.

It is another object of the present invention to provide a method and apparatus for controlled retention of filament formed on the peripheral surface of a rotating chill roll, which avoids danger of damage to the surface of the chill roll.

SUMMARY OF THE INVENTION

In accordance with the present invention, there is provided an improvement in the process for making metal filament by depositing molten metal onto the peripheral surface of a rotating chill roll and separating the solid filament from the chill roll, which involves applying tension to the filament after it has been separated from the chill roll along the direction of a tangent to the chill roll past the point at which said filament would be separated from the chill roll by action of centrifugal force, to thereby retain the filament on the chill roll to prolong contact between the filament and the chill roll, and collecting the filament.

The method of the present invention provides prolonged contact of the metal filament deposited on the peripheral surface of a rotating chill roll, thereby enhancing cooling of the molten metal to and below the critical glass transition temperature as is necessary for the production of amorphous metal filaments. The method of the present invention is eminently suited for making filaments of polycrystalline metals, of alloys forming solids having amorphous molecular structure, and of nonductile or brittle alloys which are not readily formable into filaments using conventional procedures. It provides for separation of the filament at a predetermined point and thus aids subsequent guiding of the separated filament to a point of collection, such as a winding apparatus.

The present invention further provides apparatus for making metal filaments comprising a rotably mounted annular chill roll; means for depositing molten metal onto the peripheral surface of the rotating chill roll; and means for applying tension to the filament, after it has been separated from the chill roll, along the direction of a tangent to the chill roll which tangent touches the chill roll at a point located past the point at which said filament would be separated from the chill roll by action of centrifugal force, so as to retain the filament on the chill roll to prolong contact between the filament and the chill roll.

The apparatus may further comprise holding means for the means for applying tension to the filament for holding said means for applying tension in a first position in alignment with the direction of flight of the filament as it is formed on the chill roll and flung away therefrom by centrifugal action, and to move said means for applying tension into a second position in alignment with a tangent to the chill roll past the point at which the filament is separated from the chill roll by action of centrifugal force.

BRIEF DESCRIPTION OF THE DRAWINGS

The annexed drawings, wherein like reference numerals denote like parts, further illustrate the present invention.

In FIG. 4 these means comprise a pair of felt-covered counter-rotating nip rolls; in FIG. 5, a solid roll in combination with a felt-covered roll.

DETAILED DESCRIPTION OF THE INVENTION AND OF THE PREFERRED EMBODIMENTS

Figure 1:
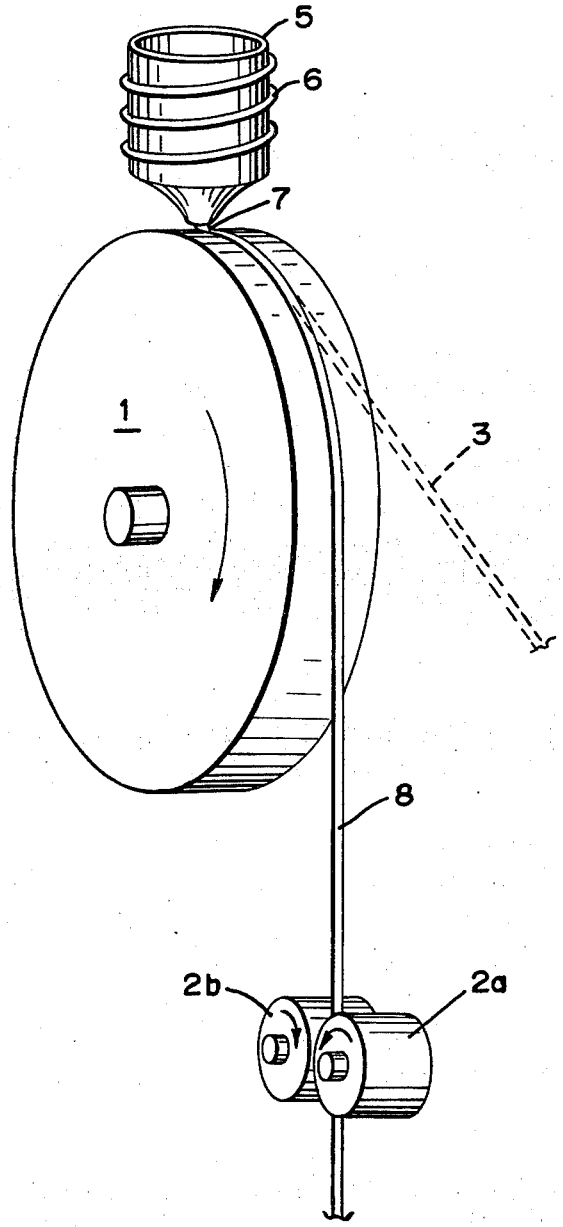
FIG. 1 provides an isometric view of a chill roll with associated casting equipment for the molten metal employing a pair of nip rolls to apply tension to the separated filament along a tangent to the chill roll past the point the filament would be separated from the chill roll by action of centrifugal force.

With reference to FIG. 1 of the drawings, apparatus employed includes a chill roll 1 rotably mounted around its longitudinal axis, together with a pair of driven, counter-rotating nip rolls *2a* and *2b* (driving means not shown) adapted to apply tension to the filament after it has been separated from the chill roll 1. Tension is applied to the filament along the direction of a tangent to the chill roll, which tangent touches the chill roll of a point located past the point at which the filament would be separated from the chill roll by action of centrifugal force, and be flung away from the chill roll. The trajectory of the untensioned filament is indicated by broken lines at 3. By virtue of the applied tension, the filament is retained on the chill roll to prolong contact between the filament and the chill roll. Associated with the apparatus is crucible 5 having an aperture in the bottom for squirting molten metal therefrom. Crucible 5 is equipped with induction heating coils 6. Other suitable means for maintaining the metal in the crucible above its melting point may be employed. In operation, a pool of molten metal is maintained in crucible 5 and is pressurized, as by padding it with inert gas (introduced by means not shown). Pressurization of the molten metal in crucible 5 results in squirting a jet of molten metal 7 for impingement on the peripheral surface of chill roll 1 to form filament 8 thereon. In usual operation, filament 8 would separate from the chill roll by action of centrifugal force and would be flung away therefrom generally in the direction indicated by broken lines at 3. The filament 8 may be caught by means of a guide, or by means and in the manner further described in detail in connection with discussion of FIG. 3, below, to be fed into the nip between counter-rotating nip rolls *2a* and *2b*. Nip rolls *2a* and *2b* engage filament 8 and apply tension to it, thereby holding it in contact with chill roll 1 for extended distance, and withdrawing it from the chill roll at a point at which the tangent, drawn from the point at which filament is engaged by nip rolls *2a* and *2b* to chill roll 1, touches chill roll 1. Desirably, filament 8 is held between nip rolls *2a* and *2b* by frictional engagement, and nip rolls *2a* and *2b* are rotated at a peripheral velocity slightly in excess of that of the surface of chill roll 1, thereby applying tension to the filament. Nip rolls *2a* and *2b* may be so arranged with respect to chill roll 1 as to wrap the filament around the peripheral surface of the chill roll for an angular distance of less than 360°, but more than that represented by the arc for which the untensioned filament is held onto the chill roll surface by adhesion. Desirably, that angular distance is less than about 270°, preferably in the order of from about 30° to about 200°, regardless of the means employed for applying tension to the filament.

Figure 2:
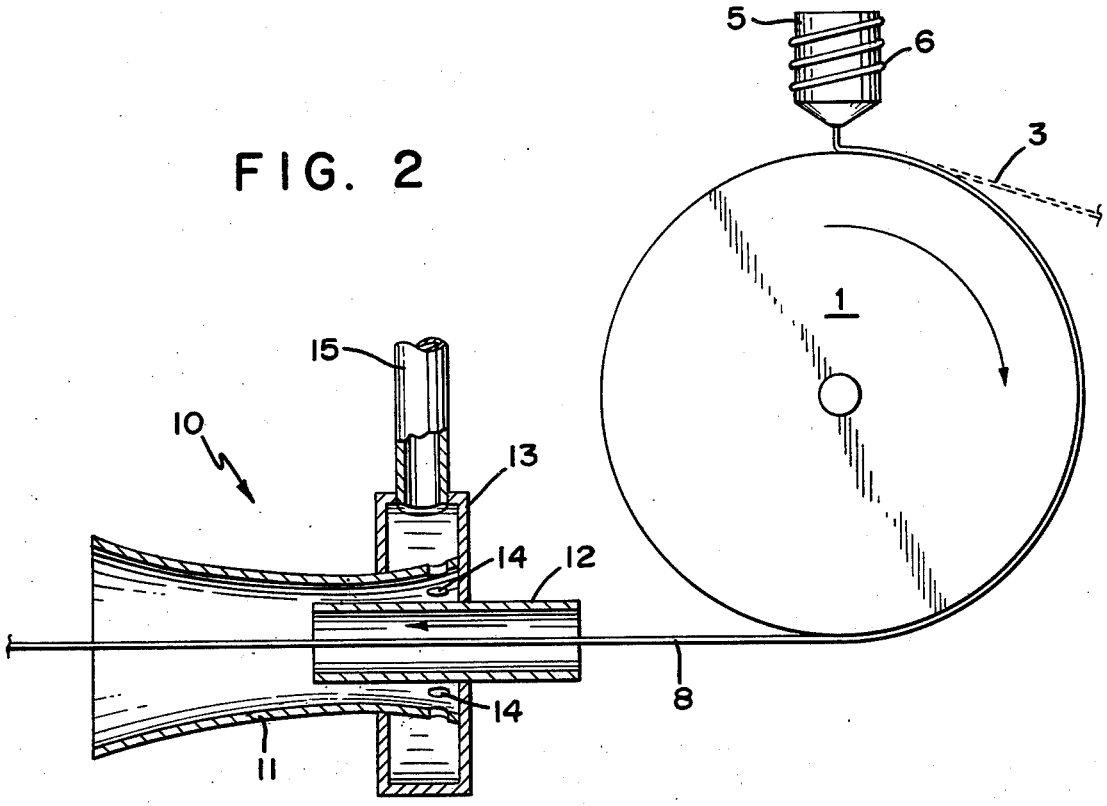
FIG. 2 provides a side view in partial cross-section of a chill roll employing an aspirator to apply tension to the filament.

FIG. 2 illustrates in partial cross-section a preferred means for applying tension to the filament and its arrangement in relation to the chill roll. The means for applying tension to the filament comprises an aspirator 10. It should be appreciated that in FIG. 2 aspirator 10 and chill roll 1 with associated equipment are not drawn to the same scale, but that they are shown in relation to each other only to illustrate arrangement. Aspirator 10 comprises venturi tube 11, filament feed tube 12, plenum chamber 13 and gas inlet 15. Venturi tube 11 has circumferentially spaced gas feed apertures 14 at its inlet end. Filament feed tube 12 for guiding filament 8 into venturi tube 11 is located partially within venturi tube 11, terminating at or near its area of tightest constriction. Inlet end of venturi tube 11 with gas feed apertures 14 is surrounded by plenum chamber 13 for supplying gas under pressure to the venturi tube. Gas is supplied to plenum chamber 13 via gas inlet 15. In operation, air or other gas is supplied to the plenum chamber and flows through the venturi tube to exit in the direction away from the chill roll. Gas flow through the venturi tube creates a vacuum at the point of restriction, which in turn causes air to flow through the filament feed tube in the direction indicated by the arrow. The flow of air over the filament within filament feed tube 12 and venturi tube 11 imparts tension to the filament, thereby holding it in engagement with chill roll 1. The amount of tension applied by aspirator 10 is conveniently regulated by regulating the amount of gas introduced into the venturi tube, the tension increasing with increasing gas flow.

Figure 3:
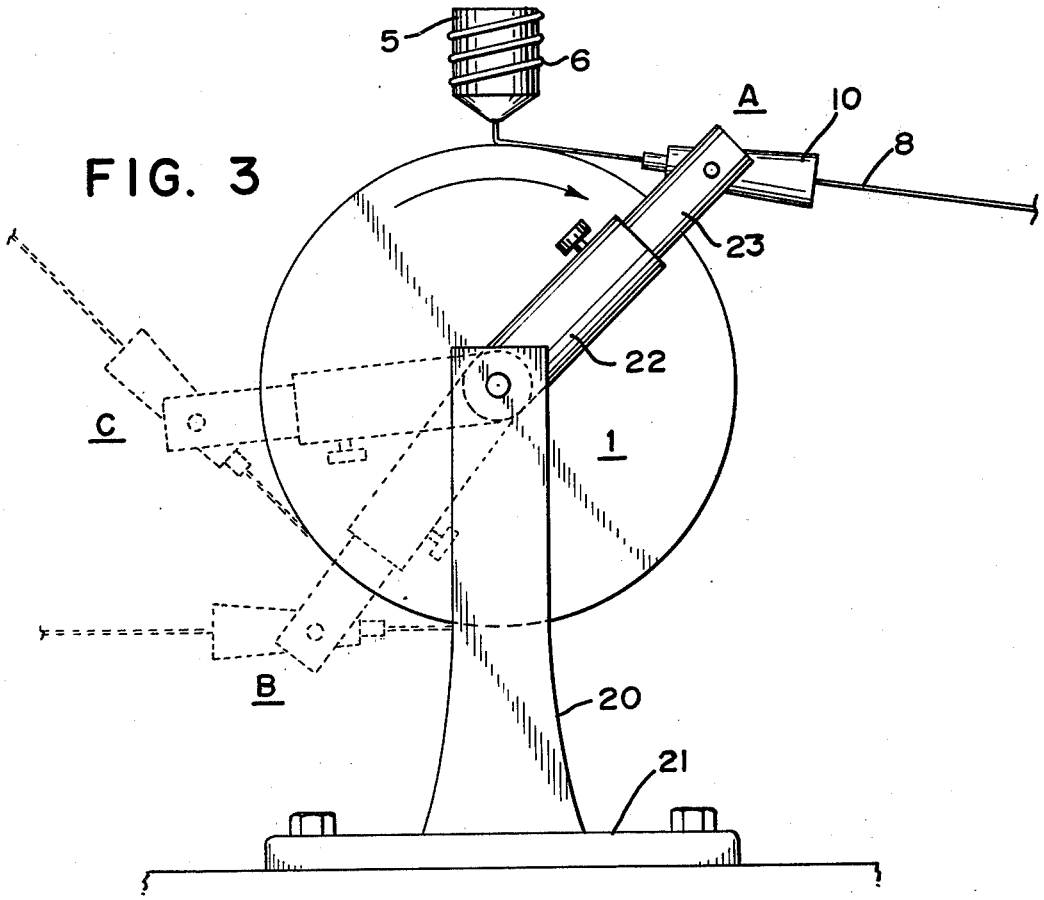
FIG. 3 provides a side view of a chill roll employing an aspirator to apply tension to the filament further illustrating holding means for the aspirator permitting adjustment in the point of departure of the filament from the chill roll.

FIG. 3 illustrates support structure for the tension means which permits capture of the filament from its normal trajectory at initiation of operation, and subsequent "wrapping around" of the filament past the point at which it would separate from the chill roll by action of centrifugal force to be flung away therefrom. Tension is applied to the filament by means of aspirator 10. Any other suitable tension means may be employed. Aspirator 10 is mounted on a holder comprising support arm 20 and pivot arm 22. Support arm 20 may be mounted on a base 21, as illustrated in FIG. 3. Pivot arm 22 is pivotally mounted on support arm 20, the pivot point being in alignment with the axis of rotation of chill roll 1. Pivot arm 22 may further comprise optional extension 23. By extending or retracting extension 23, aspirator 10 may be held further away from or closer to chill roll 1, as desired. Aspirator 10 is pivotally mounted on pivot arm 22, or its extension 23, if provided. At initiation of operation, aspirator 10 is aligned in the direction of flight of the filament 8 as it is formed and flung away from the surface of chill roll 1 by centrifugal action. Air or other gas is fed to aspirator 8 to apply tension to filament 8 at that point. Once filament 8 is running under tension through aspirator 10, pivot arm 22 may be turned around its pivot point in the direction of rotation of the chill roll into positions away from the point of 30 deposition of the metal onto the chill roll, such as illustrated as positions B and C in FIG. 3, thereby retaining the filament 8 on the peripheral surface of chill roll 1 for extended periods. Other means of applying tension to filament 8 may be substituted for aspirator 10, such as nip rolls, as illustrated in FIG. 1, especially felt-covered nip rolls, as illustrated in FIGS. 4 and 5 to be discussed below.

Figure 4:
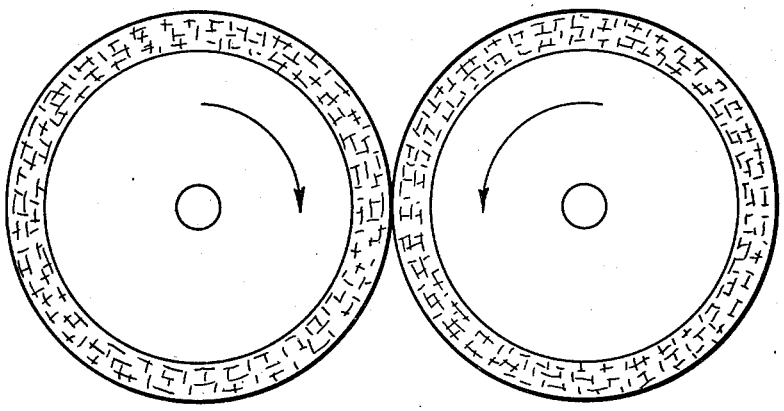
FIGS. 4 and 5 illustrate further means for applying tension to the filament.
Figure 5:
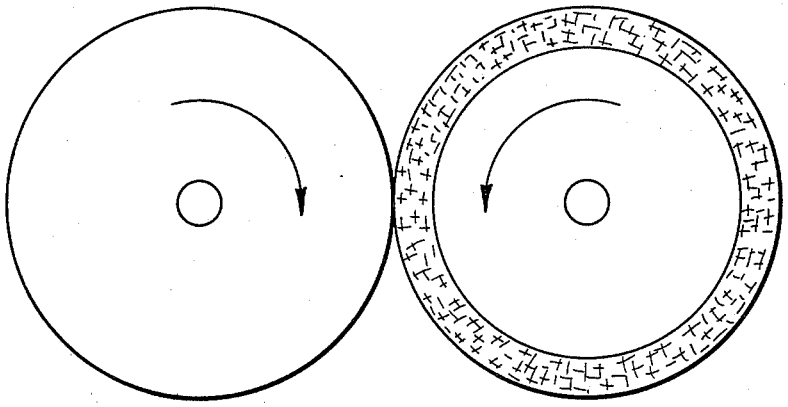

FIG. 4 illustrates a modified form of nip roll for applying tension to the filament having a felt-covered surface for engaging the filament. Preferably, these felt-covered nip rolls rotate at the point of nip at a speed in excess of the velocity of travel of the filament to thereby impart tension to the filament. FIG. 5 illustrates use of a solid roll in combination with a felt-covered nip roll, also counter rotating. In the embodiments shown by FIGS. 4 and 5, tension on the filament can be varied by varying the speed of rotation of the nip rolls, or by increasing the pressure with which the felt-covered nip rolls, as in FIG. 4, or the solid nip roll and the felt-covered nip roll, as in FIG. 5, are pressed against each other. Other means for applying tension will readily occur to those skilled in the art.

My invention permits retaining a chill cast filament on the rotating chill roll long enough and in sufficiently close contact to accomplish cooling of the filament to a predetermined temperature before the filament is separated from the chill roll. The centripetal force, Fi, necessary to retain a unit of length of filament on the surface of the chill roll can be represented by the relationship:

$$Fi=\rho v^2/r$$

wherein:

$\rho$=mass of the filament per unit length v=tangential velocity of the filament r=radius of curvature of the centerline of the filament around the chill roll.

Initially, as the molten metal solidifies and cools on the chill roll surface, there is generally sufficient adhesion between the filament and the surface to provide the necessary centripetal force, Fi, to retain a unit length of filament in contact with the chill roll. However, as the filament progressively cools, the adhesion between the filament and the chill roll surface decreases until the filament separates from the chill roll. By applying tension, $F_T$, to the filament, a clasping effect can be achieved which attempts to hold the filament against the chill roll surface according to the relationship:

$$F_T=rF_c$$

wherein $F_c$ is the clasping force component exerted by a unit length of filament toward its center of radius, as a result of tensile force $F_T$. To retain the filament in contact with the chill roll after the adhesion between the filament and the chill roll surface has been lost, the following relationships must be satisfied:

$$F_c \geqq Fi$$

$$F_T \geqq \rho v^2$$

Tensile force $F_T$ should not be made excessively large in order to avoid either breaking of the filament as or after it leaves the surface of the chill roll, or dragging of the filament around the surface of the chill roll and causing it to break at a point where it is still at a temperature too high, hence too weak, to resist the transmitted tensile force. However, the transmitted tensile force is reduced by the frictional component exerted between the surface of the chill roll and the filament to the point where the adhesion between the chill roll and the filament is still sufficient to exert substantial reduction of the transmitted tensile component to nullify the transmitted component's ability to break the filament where the filament is hot and weak. In effect, then, tensile force $F_T$ can be increased as the angular distance increases between the point at which the filament would separate by centrifugal force, and the point to which it is held by virtue of the applied tensile force.

The molten metal which is to be formed into a filament may be deposited onto the peripheral surface of the chill roll by any suitable means. For purposes of the present invention, the means by which this is accomplished are not critical. One suitable method is illustrated in the drawings and involves heating the metal, preferably in inert atmosphere or under atmospheric pressure, to temperature approximately 50° to 100° C. above its melting point, or higher, and then ejecting the molten metal through a nozzle for deposition onto the chill roll, as by pressurizing the metal with an inert gas to a pressure on the order of, say, 1 to 50 psig or until a stream of molten metal is ejected through the nozzle.

The peripheral surface of the chill roll which provides the actual quench surface can be any material having sufficient structural strengths and thermal resistance and having relatively high thermal conductivity. This latter requirement is particularly critical if it is desired to make filament having amorphous or metastable molecular structure. Preferred materials of construction for the chill roll include beryllium copper, oxygen-free copper and stainless steel. To provide protection against corrosion, erosion or thermal fatigue, the peripheral surface of the chill roll may be coated with a suitable resistant or high melting coating, for example, a ceramic coating or a coating of corrosion-resistant metal, which coating may be applied by known procedures.

Detailed design and construction of apparatus of the present invention is within the capability of any competent worker skilled in the art.

The following example further illustrates the present invention and sets forth the best mode presently contemplated for its practice.

EXAMPLE

Apparatus employed is similar to that depicted in FIG. 3. It employs an aspirator as means for applying tension, as illustrated in FIG. 2. The chill roll employed has an outer diameter of 15 inches and it is 4 15/16 inches wide. It is rotated at a speed of about 1000 rpm. By experiment, it is determined that a filament obtained by impinging a jet of molten metal of 0.020 inches diameter onto the peripheral surface of the chill roll will separate therefrom and be tangentially flung away from the chill roll at a point about 15° away from the point of deposition of the molten metal onto the peripheral surface of the chill roll. The aspirator is aligned with a tangent to the point of the chill roll 15° away from the point of deposition from the metal. A jet of molten metal of 0.020 inch diameter is then impinged onto the peripheral surface of the chill roll, and the filament formed and flung away from the chill roll flies through the aspirator. Air is supplied to the aspirator to apply tension to the filament. After the filament is being drawn through the aspirator by tension created by the air flow through it, pivot arm 22 is turned around its pivot point away from the point of deposition of the molten metal onto the chill roll to maintain the filament in contact with the chill roll through an arc of about 190° and the operation is continued. The metal solidifies on the surface of the chill roll into a ribbon of about 0.015 inch thickness and 0.042 inch width. As indicated by X-ray diffractometry, it has non-crystalline structure throughout.

Since various changes and modification may be made in the invention without departing from the spirit and essential characteristics, it is intended that all metal contained in the above descriptions shall be interpreted as illustrative only of the invention being limited only by the scope of the appended claims.

I claim:

1. The improvement in the process of making metal filament by depositing molten metal onto the peripheral surface of a rotating annular chill roll and separating the solid filament from the chill roll, which comprises:

(a) capturing the filament in its normal trajectory from the point at which the filament is separated from the chill roll by action of centrifugal force and, by means of an aspirator, applying tension to the filament in a first direction tangential to the chill roll away from the point at which the filament is separated from the chill roll by centrifugal force; and (b) maintaining tension on the filament by means of said aspirator while changing the direction of the applied tension to a second direction tangential to the chill roll past the point at which the filament is separated fro the chill roll by centrifugal force, to thereby maintain the filament on the chill roll to prolong contract between the filament and the chill roll, and collecting the filament.

2. The improvement of claim 1 wherein the metal employed is an alloy which, upon rapid cooling from the melt, forms a filament having amorphous molecular structure.

3. The improvement of claim 1 wherein the filament is retained on the chill roll by means of applied tension for an annular distance of from about 30° to about 200°.

4. Apparatus for making metal filaments comprising in combination: a rotably mounted annual chill roll; means operatively connected with said annular chill roll for depositing molten metal onto the peripheral surface thereof; aspirator means for applying tension to the filament after it has been separated from the chill roll; holding means connected to the aspirator means for applying tension to the filament, said holding means adapted to hold said aspirator means for applying tension in a first position in alignment with the direction of flight of the filament as it is formed on the chill roll and flung away therefrom by action of centrifugal force, and to move said aspirator means for applying tension into a second position to hold it in alignment with a tangent to the chill roll past the point at which the filament is separated from the chill roll by action of centrifugal force, so as to retain the filament on the chill roll to prolong contact between the filament and the chill roll.

* * * * *